US005253907A

United States Patent [19]

Schnoor et al.

[11] Patent Number: 5,253,907

[45] Date of Patent: Oct. 19, 1993

[54] LOCKING DEVICE FOR A PIVOTABLE DOOR

[75] Inventors: Christian Schnoor, Lübeck; Wolfgang Rittner, Bad Schwartau; Roderich Thometschek, Stockelsdorf; Alfred Rother, Lübeck, all of Fed. Rep. of Germany

[73] Assignee: Drägerwerk AG, Lübeck, Fed. Rep. of Germany

[21] Appl. No.: 945,734

[22] Filed: Sep. 16, 1992

[30] Foreign Application Priority Data

Sep. 19, 1991 [DE] Fed. Rep. of Germany ..... 4131156

[51] Int. Cl.[5] ..... E05C 19/00

[52] U.S. Cl. ..... 292/252; 292/DIG. 60

[58] Field of Search ..... 292/252, DIG. 60, DIG. 72, 292/341.17, 341.18, 341.19, DIG. 44, 305, DIG. 4, DIG. 36; 411/348

[56] References Cited

U.S. PATENT DOCUMENTS

| | | | |
|---|---|---|---|
| 2,355,895 | 8/1944 | Roberts | 292/2 X |
| 2,934,293 | 4/1960 | Boehme | 244/118 |
| 3,415,561 | 12/1968 | Bryson et al. | 292/341.19 |
| 3,658,370 | 4/1972 | Wang | 292/252 X |
| 3,764,172 | 10/1973 | Standke | 292/252 X |
| 4,023,874 | 5/1977 | Jong et al. | 312/291 |
| 4,071,271 | 1/1978 | Bourrie et al. | 292/252 X |
| 4,111,477 | 9/1978 | Rigali | 292/252 |
| 4,339,853 | 7/1982 | Lipschitz | 292/252 X |
| 4,538,843 | 9/1985 | Harris | 292/113 |
| 4,597,599 | 7/1986 | Bisbing | 292/DIG. 72 X |
| 4,796,930 | 1/1989 | Baynes | 292/DIG. 60 X |
| 4,852,919 | 8/1989 | Nimee et al. | 292/DIG. 60 X |

FOREIGN PATENT DOCUMENTS 9100626.0 1/1991 Fed. Rep. of Germany .

*Primary Examiner*—Rodney M. Lindsey
*Attorney, Agent, or Firm*—McGlew and Tuttle

[57] ABSTRACT

A locking device for a door (3) of a container that is pivotable around a hinge with a first locking part (5) arranged stationary on the container, and a coupling pin (7) connected to the door (3). The coupling pin acts together with the first locking part (5) in an interlocking manner. Such that a simple adjustment of the door (3) is possible, it is provided that the first locking part (5) is attached outside the container on a mounting plane (6) which is integral with the container in the over-lapping area of the door (3), the coupling pin (7) is stroke-changeably mounted in a pin holding device (25), and that the coupling pin (7) has a first adjustment device (27) on its top end pointing to the rocker arm (18), with which, by action of an adjusting tool, which can be inserted into the locking piston (13) from the rocker arm, the depth of engagement of the coupling pin (7) into the first locking part (5), which determines the play between the container and the door (3), is changeable.

8 Claims, 2 Drawing Sheets

LOCKING DEVICE FOR A PIVOTABLE DOOR

FIELD OF THE INVENTION

The present invention pertains to a locking device for a door of a container and more particularly to a locking device for emergency respiration equipment which has a door that can be pivoted around a hinge with two locking parts which act together in an interlocking manner, of which a first locking part is arranged stationary on the container and can be moved into the release position by the action of a rocker arm, which is actuated by a solenoid, on a tubular locking piston, and a second locking part is designed as a coupling pin with an undercut, which is connected to the door.

BACKGROUND OF THE INVENTION

A locking device of this class has become known from DE-GM 91,00,626.

The known locking device consists of a solenoid with a permanent magnet connected in parallel and a rotatably mounted rocker arm, which, on the one hand, is held by the permanent magnet in a horizontal locking position, and thus, on the other hand, holds a tubular locking piston in the closed position. The locking piston exerts pressure on a ball cage via a spring, which presses the balls located in the cage into the undercut of a coupling pin. The locking piston with the spring, the ball cage and the balls are parts of a first locking part, and the coupling pin located on the door is a second locking part.

The locking device is opened when the solenoid is excited such that the retention force of the permanent magnet is counterbalanced. The rocker arm is disengaged from the pole pieces of the permanent magnet, and in so doing, releases the locking piston, whereby the balls become disengaged from the coupling pin. The door of the container is unlocked.

Locking occurs when the solenoid is not excited, whereby the coupling pin is first inserted into the first locking part, and by means of a tool, is pressed from outside the rocker arm against the pole pieces of the permanent magnet. In this case, the balls engage in the undercut of the coupling pin, and the door is locked.

It is disadvantageous in the known locking device that there is no possibility for adjustment between the first locking part and the second locking part, and process tolerances between the door and the container can only be compensated by spacing distance washers between the container and the first locking part. Since the locking device is usually installed within the container, such an adjustment is time-consuming and expensive.

U.S. Pat. No. 4,023,874 describes a container with an emergency respiration system, which is locked with a door that is pivotable around a hinge. A coupling pin, as a second locking part, is attached to the door, and a first locking part, which can be engaged with the coupling pin in an interlocking manner when the door is closed, is attached to the container. In the known container, it is disadvantageous that the locking device is not accessible when the door is locked, whereby, for example, a subsequent adjustment of the door is made more difficult upon flush sealing with the adjacent attachment plates.

U.S. Pat. No. 2,934,293 shows a container with an emergency respiration system, which can be locked with a door that is pivotable around a hinge, and has a first locking part on the container wall, which projects into the interior of the container, and has a second locking part on the inside of the door.

In the known container, it is disadvantageous that the first locking part is mounted on separate attachment rails outside of the overlapping of the door, and therefore, the design is not suitable for a modular container-insert system. An adjustment of the two locking parts is only partially possible by loosening the central attachment nut and subsequent manual shifting. Since this measure must be taken in the assembled state of the container, making the adjustment is not practicable in the case of large-scale manufacture of containers.

SUMMARY AND OBJECTS OF THE INVENTION

The primary object of the present invention is to improve a locking device for a door of a container that is pivotable around a hinge, such that a simple adjustment of the container opposite the door is possible.

The object is attained in that the locking device is attached to a mounting plane which is parallel to the door and is integral with the container in the overlapping area of the door, the coupling pin is stroke-changeably mounted in a position-changeable pin holding means opposite the door in the engagement area of the first locking part, and that the coupling pin has a first adjustment means on its top end pointing to the rocker arm, with which, by means of an adjusting tool which can be inserted from the rocker arm into the locking piston, the depth of engagement of the coupling pin into the first locking part, which determines the play between the container and the door, is changeable.

The advantage of the present invention essentially consists of the fact that the locking device mounted on the container in the over-lapping area of the door has a stroke-changeable coupling pin with a first adjustment means, which can be actuated by means of an adjusting tool, which can be inserted into the locking piston, and that the depth of engagement of the coupling pin into the first locking part is adjustable. By this means, when the door is locked, the length of the coupling pin can be varied until a play between the door and the container, which is possibly present, is counterbalanced, e.g., by means of process tolerances. By depth of engagement is meant the length of the coupling pin in relation to the first locking part. When the depth of engagement is too great, there is a play-between the door and the container, while, when the depth of engagement is too small, an interlocking action of the locking part is no longer possible, and the door can no longer be locked. The length of the coupling pin can be changed in the manner that said coupling pin is provided with a set screw on its shank, which can be screwed into a corresponding screw mounting of the pin holding means on the door. The first adjustment means on the top end of the coupling pin can be a slot or hexagon socket, and the adjusting tool can be a screwdriver or hexagon insert bit key. The coupling pin can also be two pieces such as a spherical top end with a screw shank, which is rotatably inserted into a stationary cylindrical part on the pin holding means. For installing the locking device, the container is designed on the side opposite the hinges on its container edge such that a parallel mounting, which fits tightly on the door, is produced, on which mounting the locking device is attached. In the area of the coupling pin, the mounting plane is provided with a boring, such that said coupling pin can directly engage in the first locking part. The mounting plane is mounted on the container in the overlapping area of the door, and the locking device is preferably located on the outside of the container. Insofar as the locking device is arranged within the container, an adjustment boring is provided on the bottom of the container for inserting the adjusting tool. By means of the described combination of container and locking device, it is possible to make an adjustment of the door without disassembling components beforehand outside of the mounting position, and only then to insert the adjusted systems into a container-insert system in the aircraft device.

In accordance with a further feature of the invention, it is provided that, instead of the first adjustment means or in addition to said first adjustment means, a second adjustment means is provided in the area of the pin holding means, with which, by means of an adjusting tool, which can be inserted in the door by means of an adjustment boring, the depth of engagement of the coupling pin into the first locking part, which determines the play between the container and the door, is changeable. The second adjustment means can be designed equivalent to the first adjustment means. With the second adjustment means, an adjustment of the coupling pin from the surface of the door is possible.

It is advantageous to design the screw of the coupling pin as self-locking and to insert said screw into a star-shaped pin holding means, which is made of, e.g., plastic. The pin holding means is mounted in a retaining clip which is movable on the door, in order to guarantee a self-centering of the coupling pin when closing the door.

To reduce the friction between the pin holding means and the door or the retaining clip, the star-shaped side ends are advantageously spherical.

The pin holding means is attached in a locking piston manner in a retaining clip on the door. The locking piston can be obtained in the manner that the side ends are blocked by the retaining clip in the case of a possible rotation. The locking-piston mounting of the pin holding means improves the adjustment of the coupling pin with the adjusting tool.

The rocker arm is advantageously actuated by the door upon closing such that the first locking part is moved into the closed position, and the rocker arm is held in this position by the retention force of the permanent magnet.

The various features of novelty which characterize the invention are pointed out with particularly in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
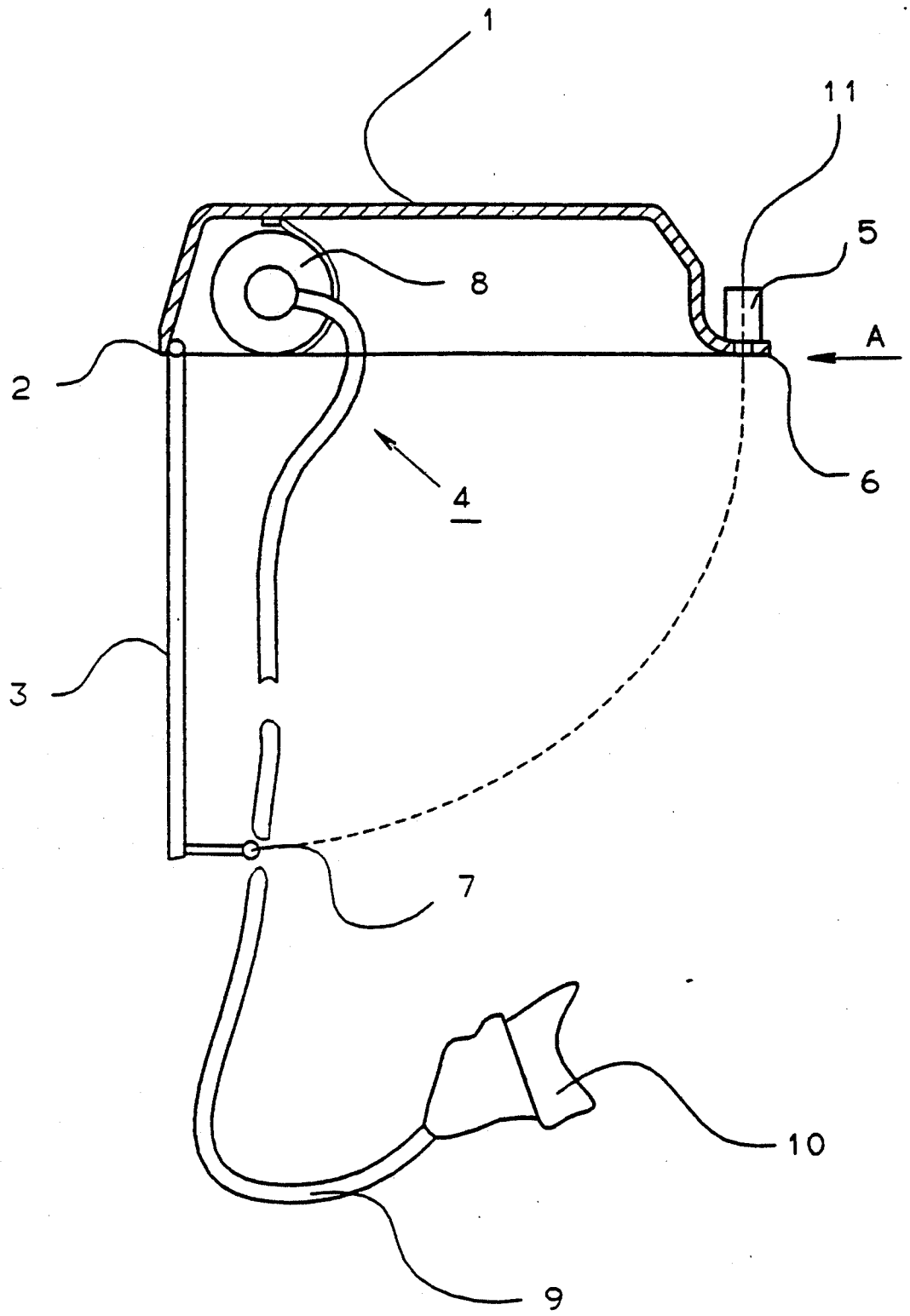
FIG. 1 is a partially sectional view of a container with a locking device for a pivotable door.

FIG. 1 shows a container 1 with a door 3 that is pivotable around a hinge 2 for supporting an emergency respiration system 4. In FIG. 1, the opened position is shown, in which the emergency respiration system 4 is accessible. During the standby phase, the door 3 is held in the closed position by means of a locking device. The locking device consists of two locking parts which act together in an interlocking manner, of which a first locking part 5 is arranged stationary outside of the container 1 on a mounting plane 6 that is integral with the container 1, and a second locking part is a coupling pin 7 connected with the door 3. The first locking part 5 is located in the overlapping area of the door 3. The emergency respiration system 4, folded during the standby phase, is arranged in the container and essentially consists of an oxygen-producing cartridge 8, a tube 9 and a breathing mask 10.

Figure 2:
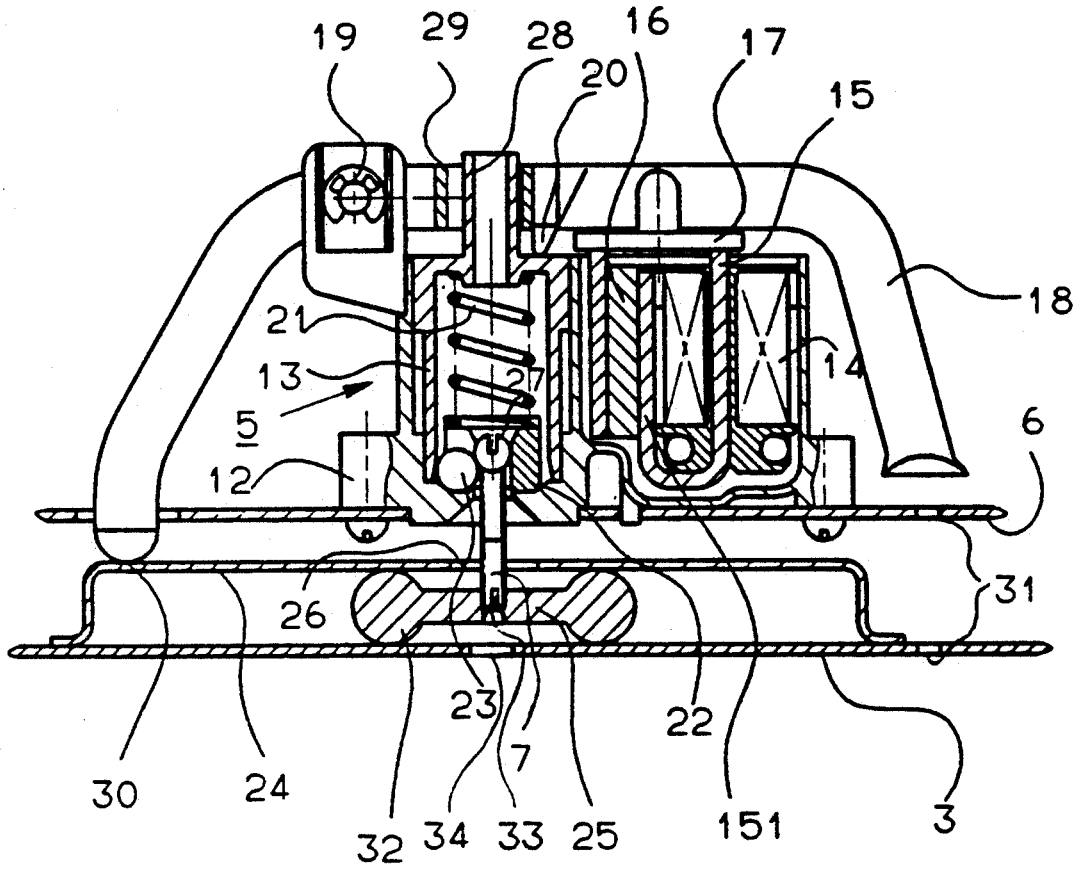
FIG. 2 is a sectional view which shows a locking device according to FIG. 1, wherein the sectional view is in the direction taken along section line II, with the door in a closed position.

FIG. 2 shows the view A of FIG. 1 along the sectional line 11 with the door 3 in the closed position. The same components are designated with the same reference numbers as in FIG. 1. The first locking part 5 comprises a housing 12 with a cylindrical boring for a locking piston 13 and a support for a solenoid 14, which is shifted on a U-shaped, arced pole piece 15, and has a permanent magnet 16 on the left side 151 of the pole piece 15. The solenoid 14 and the permanent magnet 16 are series connected with regard to the magnetic flow, but with flow directions in opposite directions. The magnetic flow is closed by a plate 17 lying on the pole piece 15. The plate 17 is attached to a rocker arm 18, which is pivotably mounted in a joint 19 on the housing 12. The rocker arm 18 holds the locking piston 13 in the closed position by means of a projecting part 20.

Within the locking piston 13 is located a spring 21, which fits tightly on a ball cage 22 with three balls 23. Of the three balls 23, only one ball is shown in FIG. 2. The first locking part 5 is attached to the mounting plane 6 by means of attachment screws. Opposite the mounting plane 6 is located a part of the door 3, which has a retaining clip 24 for a pin holding means 25 with the screwed-in, spherical coupling pin 7. The pin holding means 25 is attached within the retaining clip 24 in a movable but piston-locking manner. The coupling pin 7 is movable within the center hole of the first locking part 5 and has a first adjustment means 27 in the form of a slot. The locking piston 13 is provided with an adjusting tube 28, such that the first adjustment means 27 is accessible from outside, i.e., from the side of the rocker arm 18. In the area of the adjusting tube 28, the rocker arm 18 is guided around the adjusting tube 28 as lugs 29. In the position shown in FIG. 2, the balls 23 engage in an undercut of the coupling pin 7, by means of which the door 3 is locked. The rocker arm 18 is held in the horizontal locking position by means of the retention force of the permanent magnet 16 acting on the plate 17. If now the door 3 should be adjusted with regard to the mounting plane 6 or the container 1, an adjusting tool (not shown in FIG. 2), for example, a screwdriver, is inserted into the first adjustment means 27 by means of the adjusting tube 28, and by turning, the coupling pin 7 is more or less unscrewed from the pin holding means 25 or screwed in. By this means, the play between the door 3 and the container 1 can be adjusted with the door 3 closed. Another adjustment possibility for the coupling pin 7 involves a second adjustment means 33, which can be actuated by means of an adjusting tool via an adjusting boring 34 in the door 3. In this manner, the play between the door 3 and the container 1 can also be readjusted from the surface of the door 3 in the assembled state. The pin holding means 25 is provided with spherical side ends 32 on its radially running sides, in order to minimize the frictional forces on the support points on the door 3 or the retaining clip 24.

To open the door 3, the solenoid 14 is excited for a short time in the manner that its magnetic field is directed opposite that of the permanent magnet 16. Since the static retention force on the plate 17 is counterbalanced, the rocker arm 18 is rotated around the joint 19 under the action of the spring 21, the locking piston 13 releases the ball cage 21, whereby the balls 23 disengage from the coupling pin 7, and the door 3 swings downwards.

For locking, the door 3 is swung against the mounting plane 6, whereby the coupling pin 7 is inserted into the ball cage 22. The coupling pin 7 can be centered via the center boring 26 and via a funnel-shaped opening in the housing 12. By means of the retaining clip 24, the rocker arm 18 is swung back on the pressure point 30 into the horizontal position, whereby the balls located in the locking piston 13 are pressed against the coupling pin 7 in an interlocking manner and stop the coupling pin. The plate 17 is secured on the pole pieces 15 by means of the permanent magnet 16, and the rocker arm 18 is located in the horizontal position. The solenoid 14 is currentless upon locking. If the door 3 should be unlocked in a purely mechanical manner, a pin (not shown in FIG. 2 is inserted via the test borings 31, with which the rocker arm 18 can be moved into the unlocking position.

While a specific embodiment of the invention has been shown and described in detail to illustrate the application of the principles of the invention, it will be understood that the invention may be embodied otherwise without departing from such principles.

What is claimed is:

1. A locking device for a door of a container, the door being pivotable around a hinge, comprising: a mounting plane forming a part of said container, said mounting plane extending parallel to said door in a door closed position, said mounting plane overlapping an area of said door in said door closed position; a first locking part attached to said mounting plane, said first locking part being arranged stationary on said mounting plane of said container and being connected to a rocker arm, said rocker arm being actuated by a solenoid for moving a tubular locking piston of said first locking part to achieve a release position of said tubular locking piston; a second locking part connected to said door, said second locking part including a coupling pin with an undercut, said second locking part being connected to said door via a position-changeable pin holding means for holding said coupling pin in a position with respect to said door; adjustment means for acting on said position changeable holding means for changing an amount said coupling pin is inserted into said first locking part in said door closed position, whereby a depth of engagement of said coupling pin into said first locking part is changeable, thereby determining an amount of play between said container and said door in said door closed position; and access means for access to said adjustment means when said door is in said closed position wherein said adjustment means is activated by an adjusting tool, said access means including a space for receiving said adjusting tool through said locking piston from a rocker arm side of said locking piston.

2. A locking device according to claim 1, wherein said door has a retaining clip mounted on an inside of said door, said pin holding means being positioned in said retaining clip.

3. A locking device according to claim 1, wherein said adjustment means may be activated by an adjusting tool for activating said adjustment means in an area of said pin holding means, said access means further including an adjusting boring providing access to said adjusting means in an area of said pin holding means from an outer side of said door whereby said adjustment tool is inserted through said door by means of said adjusting boring.

4. A locking device according to claim 1, wherein said first locking part is movable into a closed position of said locking piston by said rocker arm, said door actuating said rocker arm to move said first locking part into said closed position.

5. A locking device according to claim 1, wherein said adjusting means includes a first adjustment means provided on a top end of said coupling pin facing said rocker arm and a second adjusting means provided in area of said pin holding means, said space for receiving said adjusting tool through said locking piston from the rocker arm side of said piston being for activating said first adjusting means and an adjusting boring provided in said door for activating said second adjusting means by inserting a tool through said adjusting boring.

6. A locking device for a door of a container, the door being pivotable around a hinge, comprising: a mounting plane forming a part of said container, said mounting plane extending parallel to said door in a door closed position, said mounting plane overlapping an area of said door in said door closed position; a first locking part attached to said mounting plane, said first locking part being arranged stationary on said mounting plane of said container and being connected to a rocker arm, said rocker arm being actuated by a solenoid for moving a tubular locking piston of said first locking part to achieve a release position of said tubular locking piston; a second locking part connected to said door, said door having a retaining clip mounted on an inside of said door, said second locking part including a coupling pin with an undercut, said second locking part being connected to said door via a position-changeable pin holding means in said retaining clip, holding said coupling pin in a position with respect to said door; adjusting means provided in an area of said pin holding means, said adjusting means for changing a depth of engagement of said coupling pin into said first locking part, said depth of engagement determining an amount of play between said container and said door in said closed position; and access means for access to said adjusting means when said door is in a closed position, including an adjusting boring provided in said door for activating said adjusting means by inserting a tool through said adjusting boring.

7. A locking device for a door of a container, the door being pivotable around a hinge, comprising: a mounting plane forming a part of said container, said mounting plane extending parallel to said door in a door closed position, said mounting plane overlapping an area of said door in said door closed position; a first locking part attached to said mounting plane, said first locking part being arranged stationary on said mounting plane of said container and being connected to a rocker arm, said rocker arm being actuated by a solenoid for moving a tubular locking piston of said first locking part to achieve a release position of said tubular locking piston; a second locking part connected to said door, said second locking part including a coupling pin with an undercut, said second locking part being connected to said door via a position-changeable pin holding means for holding said coupling pin in a position with respect to said door; adjusting means provided on a top end of said coupling pin facing said rocker arm for changing a depth of engagement of said coupling pin into said first locking part, said depth determining play between said container and said door in said closed position; and access means for access to said adjusting means when said door is in said closed position including a space for receiving an adjustment tool through said locking piston from a rocker arm side of said piston for activating said adjusting means.

8. A locking device according to claim 7, wherein said first locking part is movable into a closed position of said locking piston by said rocker arm, said door actuating said rocker arm to move said first locking part into said closed position.

* * * * *